US006035923A

United States Patent [19]

Oda et al.

[11] Patent Number: 6,035,923

[45] Date of Patent: Mar. 14, 2000

[54] METHOD OF AND APPARATUS FOR PRODUCING LIGHT ALLOY COMPOSITE MEMBER

[75] Inventors: Nobuyuki Oda; Yukihiro Sugimoto; Kazuo Sakamoto, all of Hiroshima-ken, Japan

[73] Assignee: Mazda Motor Corporation, Hiroshima, Japan

[21] Appl. No.: 08/697,556

[22] Filed: Aug. 28, 1996

[30] Foreign Application Priority Data

Aug. 30, 1995 [JP] Japan ..... 7-221746
Dec. 28, 1995 [JP] Japan ..... 7-342136

[51] Int. Cl.[7] ..... B22D 19/02; B22D 27/13

[52] U.S. Cl. ..... 164/97; 164/98; 164/120; 164/284; 164/410

[58] Field of Search ..... 164/98, 97, 119, 164/120, 284, 410

[56] References Cited

U.S. PATENT DOCUMENTS

| | | | |
|---|---|---|---|
| 2,406,333 | 8/1946 | Jensen | 164/284 |
| 3,407,864 | 10/1968 | Anderko et al. | 164/132 X |
| 5,076,341 | 12/1991 | Noguchi | 164/120 |
| 5,297,610 | 3/1994 | Noguchi et al. | 164/119 |

FOREIGN PATENT DOCUMENTS

| | | | |
|---|---|---|---|
| 2237712 | 2/1975 | France | 164/120 |
| 57-32869 | 2/1982 | Japan | 164/120 |
| 60-191654 | 9/1985 | Japan | 164/284 |
| 63-53225 | 3/1988 | Japan . | |
| 2-025700 | 6/1990 | Japan . | |
| 2-30790 | 7/1990 | Japan . | |
| 3-62776 | 9/1991 | Japan . | |

*Primary Examiner*—J. Reed Batten, Jr.
*Attorney, Agent, or Firm*—Sixbey, Friedman, Leedom & Ferguson, P.C.; Donald R. Studebaker; Robert M. Schulman

[57] ABSTRACT

A porous composite forming material is held in a cavity of a casting mold, and molten light alloy is poured into the cavity of the casting mold through a gate. Then a gas pressure is applied to the cavity in the casting mold with the cavity closed, thereby impregnating the pores of the porous composite forming material with the molten light alloy and forming a composite portion formed of a composite material of the light alloy and the composite forming material.

27 Claims, 10 Drawing Sheets

METHOD OF AND APPARATUS FOR PRODUCING LIGHT ALLOY COMPOSITE MEMBER

BACKGROUND OF THE INVENTION

1. Field of the Invention

This invention relates to a method of and an apparatus for producing a composite member of light alloy and porous materials or fiber of metal and/or inorganic material or a molded body of such porous materials or fiber.

2. Description of the Related Art

Because of its light weight and high heat conductivity, aluminum alloy has been in wide use for a material of automotive engine parts. However the aluminum alloy is disadvantageous in that it is inferior to iron materials such as cast iron or steel in heat resistance and/or wear resistance. Accordingly, for example, in a piston for a diesel engine, it has been proposed to reinforce the top ring groove, which should be high in wear resistance, by forming the periphery of the groove by a composite material of aluminum alloy and a porous material of metal such as nickel (Japanese Patent Publication No. 2(1990)-30790) or by a composite material of aluminum alloy and inorganic fiber such as alumina-silica fiber (Japanese Patent Publication No. 3(1991)-62776). Further in Japanese Unexamined Patent Publication No. 63(1988)-53225, there has been disclosed an engine cylinder sleeve formed of aluminum alloy reinforced with inorganic fiber.

In forming the reinforced portion by composite material, a high-pressure casting method is employed to impregnate the pores of a porous metal preform or an inorganic fiber preform with molten aluminum alloy. That is, a reinforcing material preform having a predetermined porosity is set in a casting mold, molten aluminum alloy is cast in the mold and then a pressure of about 300 to 1500 Kg/cm$^2$ is applied to the molten aluminum alloy by a mechanical means such as a pressure punch or plunger. The pressure is held until the molten aluminum alloy is solidified.

However this method involves the following problem due to a high pressure.

A large and expensive apparatus is necessary. A pressurizing mechanism for applying a high pressure or a strong mold clamping mechanism is necessary.

It is hard to use a disintegrating core such as a salt core or a sand core. That is, molten metal can soak into the core or the core can be deformed or broken by the high pressure.

The degree of freedom in shape of the product is low. That is, since the metal mold must withstand a high pressure, the structure of the mold is limited, and accordingly it is hard to manufacture a product of a complicated shape or of a large size.

SUMMARY OF THE INVENTION

In view of the foregoing observations and description, the primary object of the present invention is to provide a method of and an apparatus for producing a light alloy composite member which enables formation of composite portion by applying a pressurizing means using gas as a pressurizing medium in a normal gravity casting.

In accordance with one aspect of the present invention, there is provided a method of producing a light alloy composite member comprising the steps of holding a porous material for forming a composite material with light alloy (will be referred to as "composite forming material", hereinbelow) in a cavity of a casting mold, pouring molten light alloy into the cavity of the casting mold through a gate and applying a gas pressure to the cavity in the casting mold with the cavity closed thereby impregnating the pores of the porous composite forming material with the molten light alloy and forming a composite portion formed of a composite material of the light alloy and the composite forming material.

In accordance with another aspect of the present invention, there is provided a method of producing a light alloy composite member comprising the steps of holding a porous composite forming material in a cavity of a casting mold in contact with the inner surface of the casting mold, the casting mold provided with a vent means for venting gas in the composite forming material in communication with the inner surface of the casting mold in contact with the composite forming material, pouring molten light alloy into the cavity of the casting mold through a gate and applying a gas pressure to the molten light alloy in the cavity of the casting mold with the cavity closed thereby impregnating the pores of the porous composite forming material with the molten light alloy and forming a composite portion formed of a composite material of the light alloy and the composite forming material.

The expression "with the cavity closed" means that the cavity is effectively closed. That is, the expression means a state that the cavity is effectively sealed to such an extent that the gas pressure for impregnating the pores of the porous composite forming material with the molten light alloy is not relived through the gate or other passages or the like communicating with the cavity, e.g., a state where the gate is closed by a lid member or the like which directly closes the gate, a valve means which closes a part of the passage for supplying molten light alloy to the gate is closed, or in the case where an air vent hole is formed in a part of the mold, the air vent hole is closed by solidified metal with the gate closed.

As the composite forming material, porous materials or fiber of metal such as nickel, or a molded body of such porous materials or fiber of metal, or porous materials or fiber of an inorganic material such as alumina, or a molded body of such porous materials or fiber of an inorganic material may be employed. Though depending upon the kind of the composite forming material, the pre-heating temperature of the material, the temperature of the molten metal and the like, it is preferred that the composite forming material has a mean volume factor of 5 to 20%, i.e., a porosity of 80 to 95%.

When the volume factor of the composite forming material is in the range of 5 to 20%, the composite forming material is sufficiently combined with the light alloy while ensuring desired physical properties of the composite portion and shape retention of the composite forming material.

It is preferred that the gas pressure be applied through the gate and/or a sink head.

When the gas pressure is applied from other parts, voids can be produced in the product.

The gas pressure may be in the range of 0.5 to 30 kg/cm$^2$ and preferably in the range of 0.5 to 10 kg/cm$^2$.

When the gas pressure is in the range of 0.5 to 30 kg/cm$^2$, pressurized air available in the ordinary plant facilities can be used without necessity of an additional pressurized gas source, thereby further reducing cost of casting facilities.

When the gas pressure is in the range of 0.5 to 30 kg/cm$^2$, the volume factor of the composite forming material is preferably as follows.

porous material or fiber of metal up to 20% short fiber or whisker of inorganic material up to 10%
inorganic particles up to 15%

FIG. 1 shows the relation between the gas pressure and the volume factor of the composite forming material. FIG. 1 shows that, for instance, in the case of metal porous material having a volume factor of about 9%, combination of the metal porous material with the light alloy is initiated at about 0.2 kg/cm$^2$ and completed at about 2 kg/cm$^2$.

It is preferred that a vent be provided in the casting mold in communication with the composite forming material held by the casting mold to release gas in the composite forming material.

The gas in the composite forming material is effectively purged through the vent and impregnation of the molten metal into the pores of the composite forming material is promoted.

It is preferred that T6 treatment (e.g., 500° C.×4.5 h→water hardening→180° C.×5 h), T4 treatment, T5 treatment, T7 treatment, annealing or the like is carried out on the composite portion after casting.

When the composite portion is subjected to a heat treatment such as T6 treatment, an intermetallic compound layer (solid phase diffusion layer) is formed in the interface between the light alloy and the composite forming material and at the same time the light alloy matrix can be subjected to solution treatment, whereby strength, wear resistance and yield strength of the light alloy can be improved.

In accordance with still another aspect of the present invention, there is provided an apparatus for producing a light alloy composite member comprising a casting mold capable of holding a porous composite forming material in a cavity thereof, a closing means which closes the cavity after molten light alloy is poured into the cavity of the casting mold through a gate with the composite forming material held in the cavity and a pressurizing means for applying a gas pressure to the cavity in the casting mold with the cavity closed by the closing means.

In accordance with still another aspect of the present invention, there is provided an apparatus for producing a light alloy composite member comprising a casting mold which is capable of holding a porous composite forming material in a cavity thereof in contact with the inner surface of the casting mold and is provided with a vent means for venting gas in the composite forming material in communication with the inner surface of the casting mold in contact with the composite forming material, a molten metal pouring means which pours molten light alloy into the cavity of the casting mold through a gate with the composite forming material held in the cavity and a pressurizing means for applying a gas pressure to the molten light alloy in the cavity of the casting mold with the cavity closed.

The closing means is a means which can keep the cavity effectively closed. That is, the closing means keeps the cavity effectively sealed to such an extent that the gas pressure for impregnating the pores of the porous composite forming material with the molten light alloy is not relived through the gate or other passages or the like communicating with the cavity. More particularly, the closing means may comprise a lid member or the like which directly closes the gate, or a valve means which closes a part of the passage for supplying molten light alloy to the gate. In the case where an air vent hole is formed in a part of the mold, the closing means may comprise such a lid member or a valve means in combination with solidified metal in the air vent hole.

It is preferred that the gas pressure be applied through the gate and/or a sink head. Further it is preferred that the sink head be provided in a portion of the casting mold near the composite forming material held in the cavity in communication with the composite forming material.

Further it is preferred that a vent be provided in a portion of the casting mold near the composite forming material held in the cavity in communication with the composite forming material. It is further preferred that the vent be formed in a parting face of the casting mold in the case of a split mold.

When the vent is formed in a parting face of the casting mold, the molten metal enters the vent and is solidified there can be easily removed as flash after parting the mold.

In accordance with the present invention, the composite portion is formed by impregnating the pores of the composite forming material with the molten metal by applying a gas pressure, and accordingly a large and expensive casting apparatus is not necessary. Further a disintegrating core such as a salt core or a sand core may be used. Further, since the metal mold need not withstand a high pressure, the structure of the mold is not limited and the degree of freedom in shape of the product increases.

DESCRIPTION OF THE PREFERRED EMBODIMENTS

Casting of a piston for a diesel engine

Figure 1:
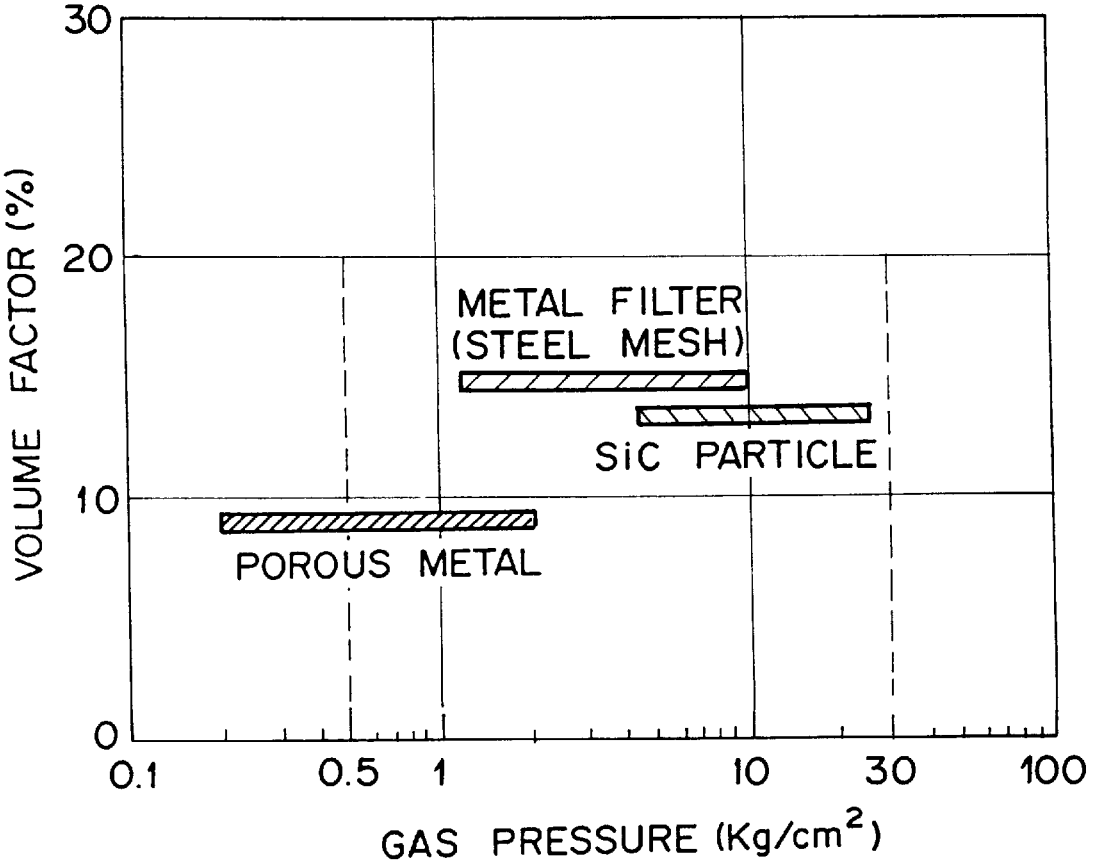
FIG. 1 is a graph showing the relation between the volume factor of the composite forming material and the gas pressure required to impregnate the composite forming material with molten metal.
Figure 2:
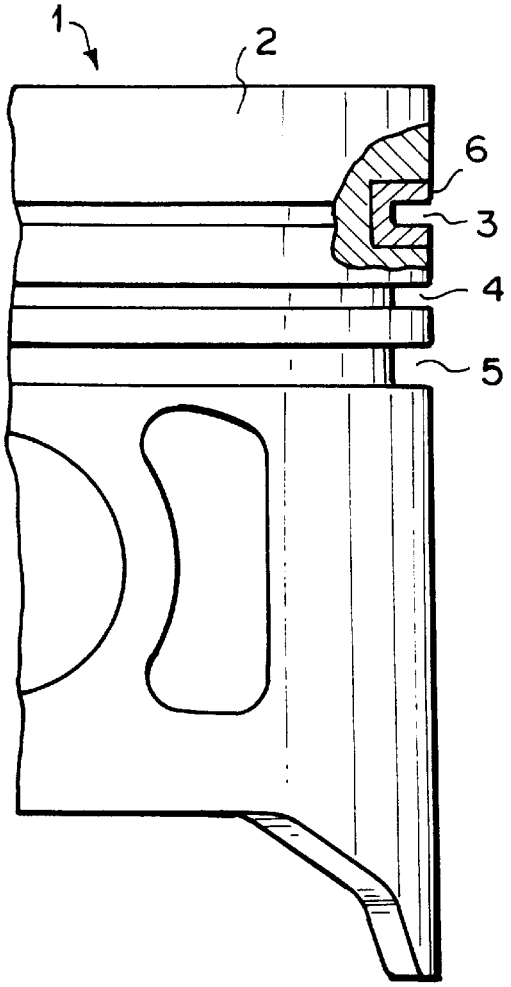
FIG. 2 is a fragmentary front view partly in cross-section showing an aluminum alloy piston manufactured by the method of the present invention.

Casting of a piston for a diesel engine shown in FIG. 2 in accordance with the method of the present invention will be described hereinbelow. As shown in FIG. 2, the piston 1 is cast from aluminum alloy and has a piston body 2. The piston body 2 has on its peripheral surface a top ring groove 3 in which a top ring is fitted, a secondary ring groove 4 in which a secondary ring is fitted and an oil ring groove 5 in which an oil ring is fitted.

The top ring groove 3 is formed on a ring like composite portion 6 which is formed by a method to be described alter, and the rest of the piston body 2 is formed of the aluminum alloy.

Figure 3:
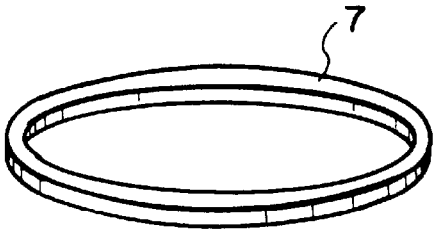
FIG. 3 is a perspective view of a ring of the composite forming material.
Figure 4:
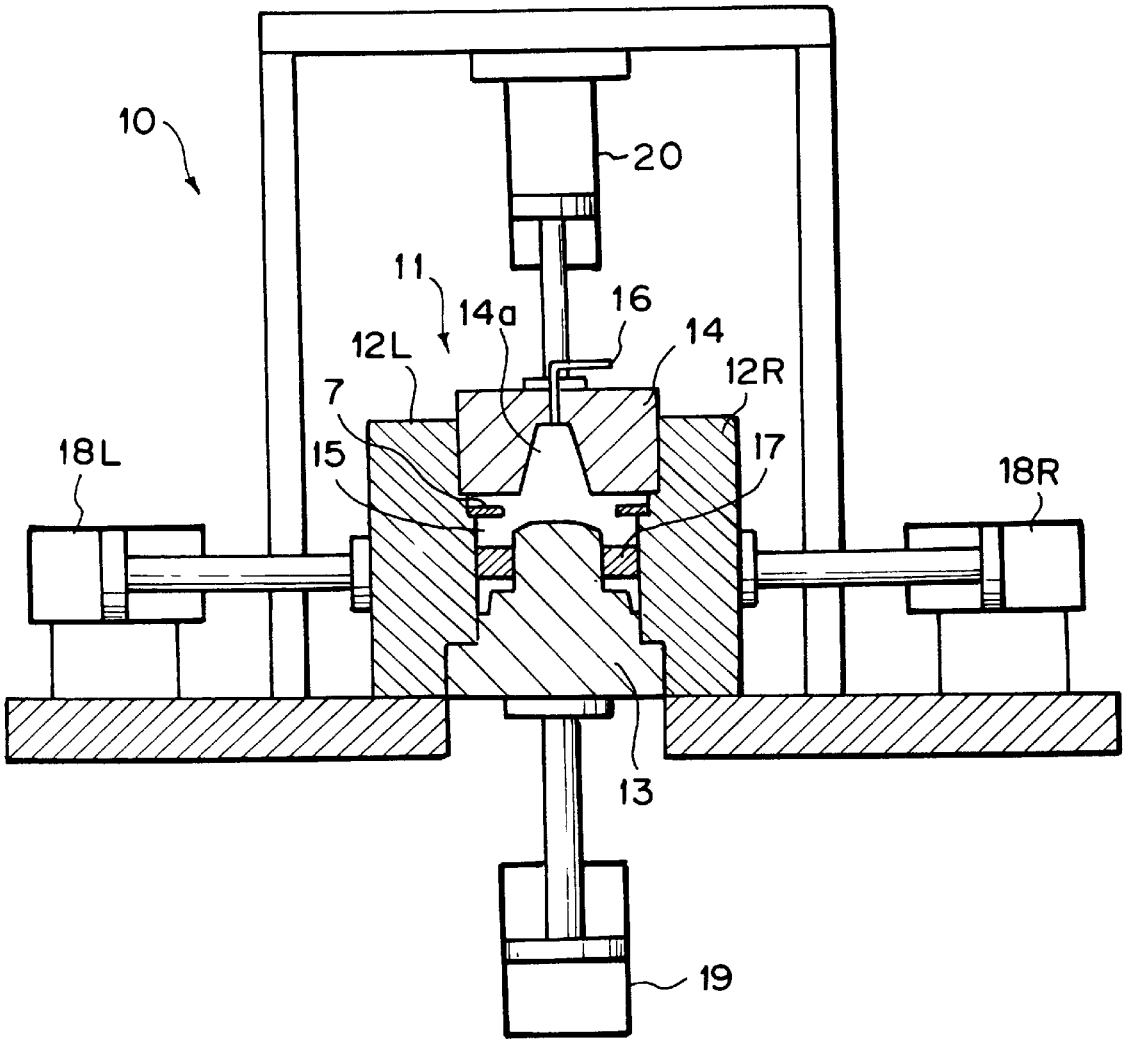
FIG. 4 is a schematic cross-sectional view of an apparatus for casting a piston in accordance with an embodiment of the present invention.

FIG. 4 shows a casting apparatus 10 in accordance with an embodiment of the present invention which can be employed for casting the piston 1. The apparatus 10 comprises a split casting mold 11 comprising left and right outer molds 12L and 12R, an intermediate mold 13 disposed on the lower side of the mold 11 and an upper mold 14 disposed on the upper side of the mold 11. The upper mold 14 is provided with a sink head portion 14*a*. A cavity 15 is formed inside the mold 11. A ring 7 of a composite forming material (FIG. 3) is held in the cavity 15. A pipe 16 for applying an air pressure through the sink head portion 14*a* is mounted on the sink head portion 14*a*. Reference numeral 17 denotes a pin for forming a piston pin insertion hole.

The left and right outer molds 12L and 12R are respectively driven by cylinders 18L and 18R, and the intermediate mold 13 and the upper mold 14 are respectively driven by cylinders 19 and 20.

The ring 7 is formed of, for instance, a porous nickel material (e.g., cermet available from Sumitomo Denkou: having a volume factor of about 5% and a mean pore opening of 0.8 mm). Since the top ring groove 3 is machined after casting, the ring 7 has no groove.

Figure 5:
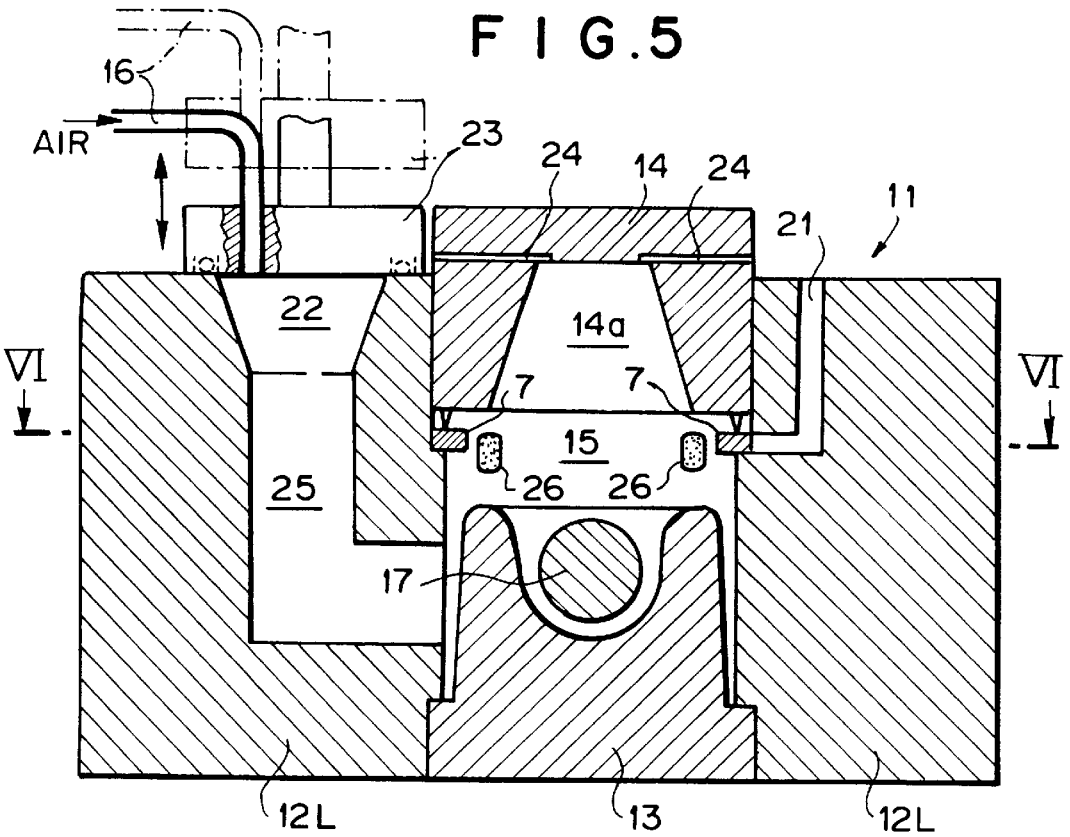
FIG. 5 is a cross-sectional view of an example of a casting mold for casting a piston in accordance with the method of the present invention.
Figure 6:
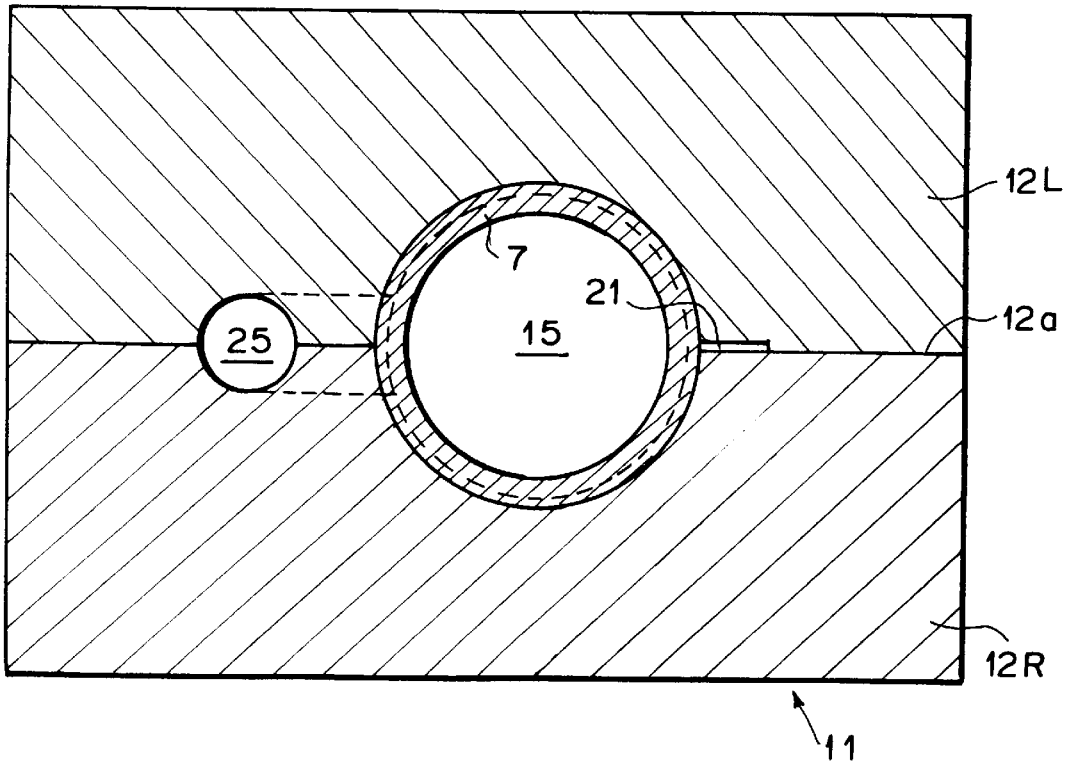
FIG. 6 is a cross-sectional view taken along line VI—VI in FIG. 5.

FIGS. 5 and 6 show an example of a casting mold 11 for casting the piston 1 with an air pressure applied to the cavity 15 through a gate. FIG. 5 is a cross-sectional view taken along a plane perpendicular to the cross-section shown in FIG. 4.

In this example, a vent groove 21 is formed in the left outer mold 12L in the parting surface 12*a* between the left and right outer molds 12L and 12R and communicates the ring 7 with atmosphere. The vent groove 21 may be about 5 to 10 mm in width and about 0.2 mm in depth. An air pipe 16 is mounted on a gate cover 23 which closes a gate 22. In this particular example, the upper mold 14 is split into upper and lower pieces and a vent groove 24 for releasing air when molten metal is poured into the cavity 15 up to the sink head portion 14*a* is formed in the parting face between the upper and lower pieces. Reference numeral 25 denotes a molten metal passage which leads to the cavity 15 from the gate 22 and reference numeral 26 denotes a salt core which is supported in a cavity 15 by a support (not shown) in order to form a cooling oil passage in the piston 1.

Molten aluminum alloy (AC8A) is poured into the cavity 15 through the gate 22 and then the cover 23 is lowered to close the gate 22 and pressurized air at 5 kg/cm$^2$ is introduced into the cavity 15 through the pipe 16, thereby pressurizing the molten metal for about 50 to 60 seconds. At this time, the molten metal enters the vent grooves 21 and 24 and is solidified therein, thereby sealing the grooves 21 and 24. The molten metal solidified in the grooves 21 and 24 is removed as flash after parting the mold 11. Introduction of the pressurized air should be initiated within 10 to 30 seconds after pouring the molten metal. The time range may be set within a range of time in which the air pressure can effectively act on the molten metal before solidification thereof.

Figure 7:
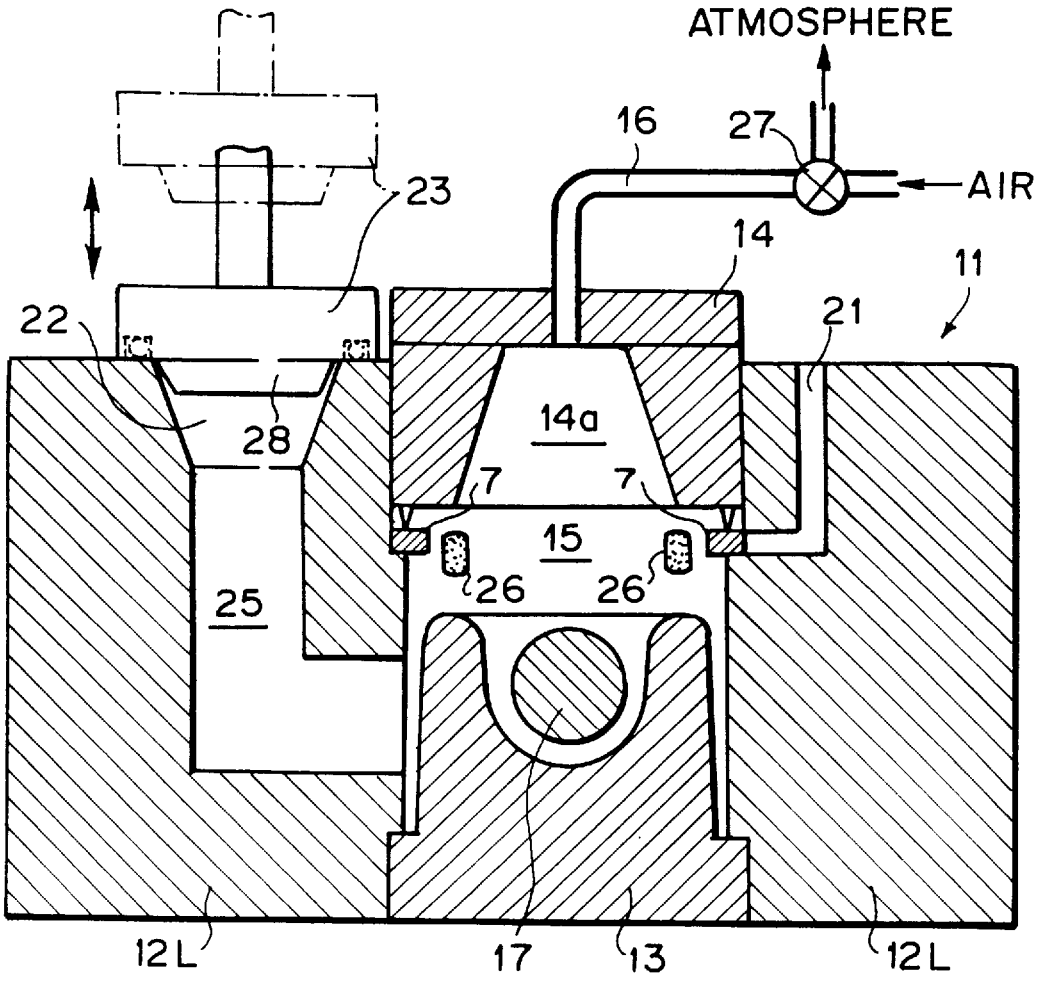
FIG. 7 is a cross-sectional view of another example of a casting mold for casting a piston in accordance with the method of the present invention.

FIG. 7 shows an example of a casting mold 11 for casting the piston 1 with an air pressure applied to the cavity 15 through the sink head portion 14*a* in the upper mold 14. In this example, a valve 27 which selectively communicates the sink head portion 14*a* with atmosphere and a pressurized air source is provided in the pipe 16. In the casting mold 11, with the sink head portion 14*a* communicated with atmosphere through the valve 27, molten aluminum alloy is poured into the cavity 15 through the gate 22 and then the gate 22 is closed by a cover 23 provided with a cooling means such as a water-cooled copper block 28. At the same time, the valve 27 is operated to communicate the sink head portion 24*a* with the pressurized air source, thereby introducing pressurized air into the cavity 15 through the pipe 16. The arrangement of the casting mold 11 shown in FIG. 7 is advantageous in that the part around the composite portion can be effectively pressurized.

Figure 8:
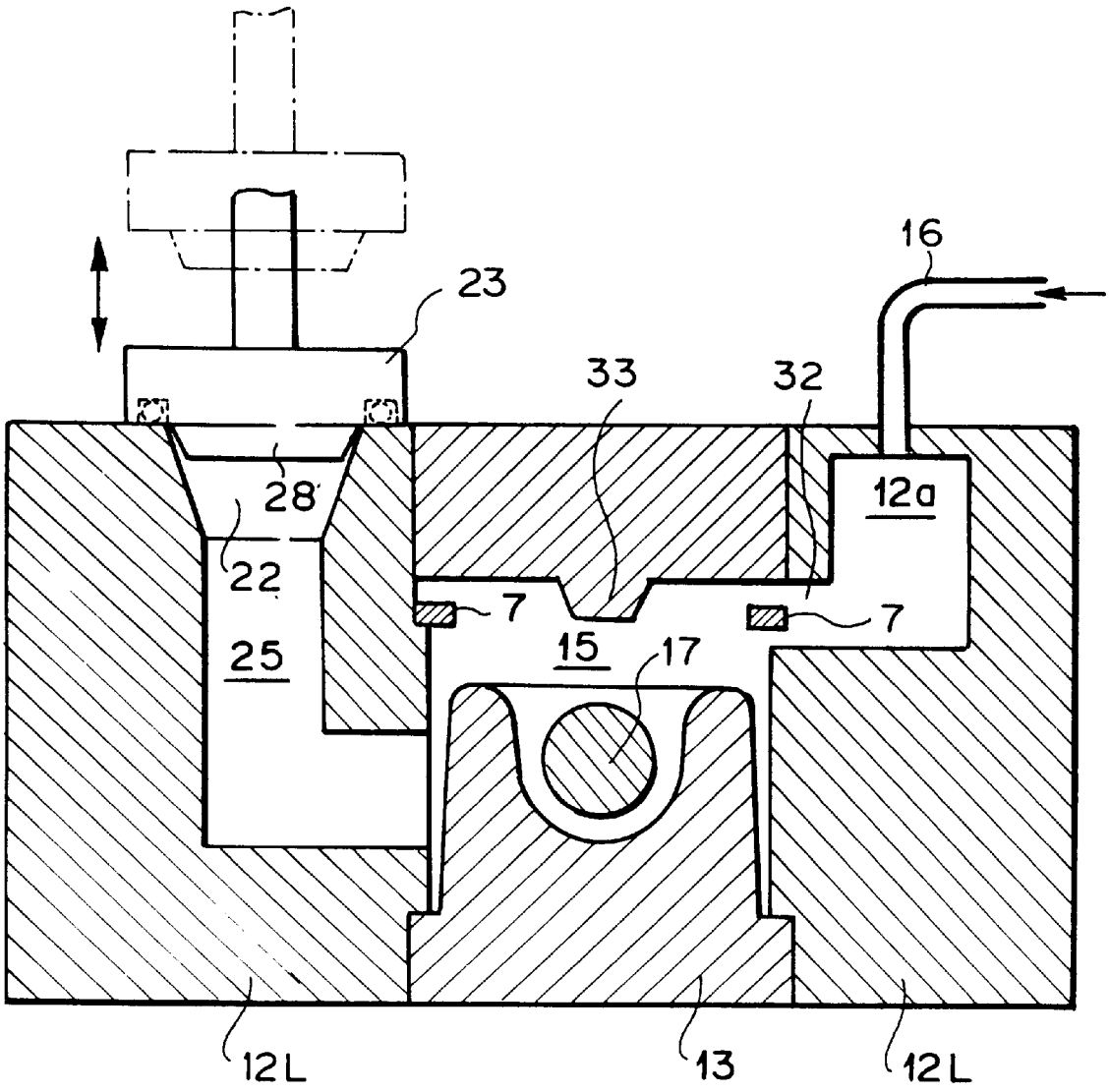
FIG. 8 is a cross-sectional view of an example of a casting mold for casting a piston for a direct fuel injection diesel engine in accordance with the method of the present invention.
Figure 9:
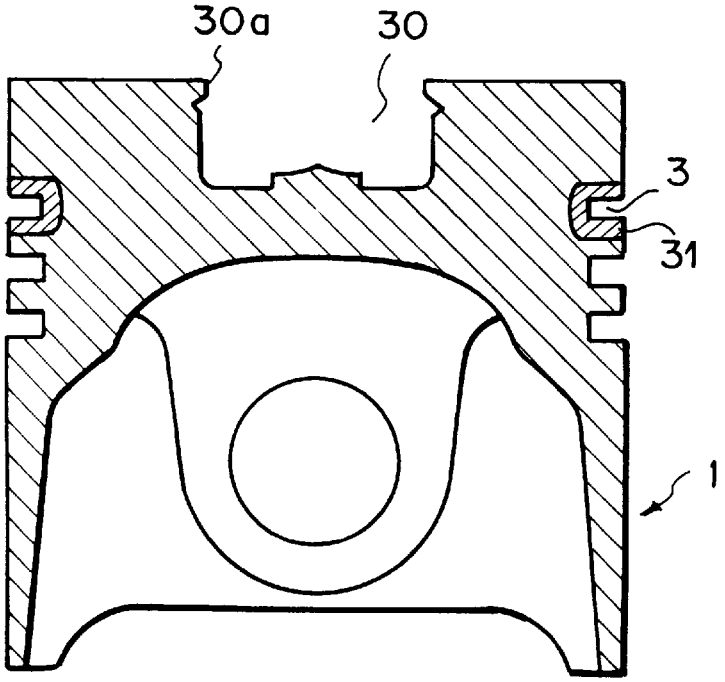
FIG. 9 is a cross-sectional view showing a piston for a direct fuel injection diesel engine.

In the casting mold 11 of another example shown in FIG. 8, a sink head portion 12*b* is formed on one side of the cavity 15 between the left and right outer molds 12L and 12R and pressurized air is introduced into the cavity 15 through the sink head portion 12*a*. This casting mold 11 is suitable for casting a piston 1 for a direct fuel injection diesel engine having a combustion chamber 30 on the top thereof.

Generally a sink head portion is provided to prevent formation of void in a thick-walled portion like a piston head. However the sink head portion results in low yield of material and when the sink head portion is provided on the top of the casting mold, the combustion chamber 30 has to be formed by machining, which takes a long time.

Further though it is preferred that the metal structure of the lip portion 30*a* of the combustion chamber 30 be fine (molten metal should be solidified rapidly) from the viewpoint of resistance to thermal fatigue, when the sink head portion is provided on the top of the casting mold, the lip portion 30*a* is slowly solidified, which results in coarse metal structure and weak resistance to thermal fatigue.

Figure 10:
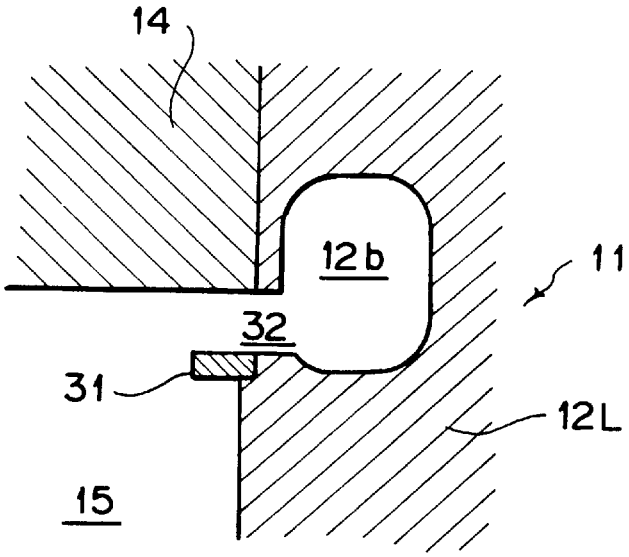
FIG.10 PRIOR ART
FIG. 10 is a fragmentary cross-sectional view of an example of a casting mold for casting a piston for a direct fuel injection diesel engine in accordance with the prior art.
Figure 11:
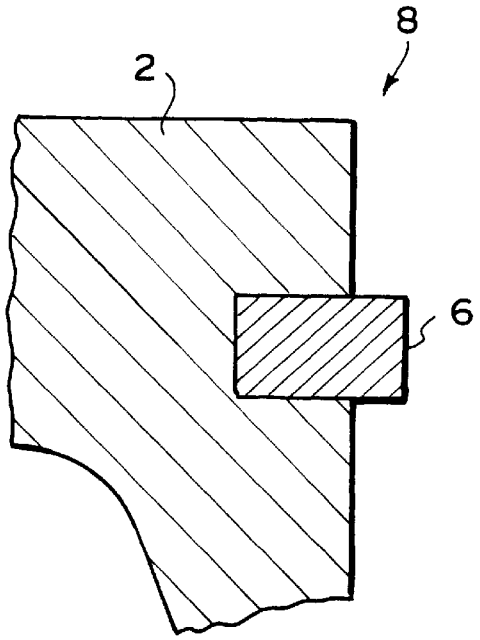
FIG. 11 is a fragmentary cross-sectional view of an aluminum alloy cast material (piston) cast in accordance with the present invention.

In the case of a conventional piston for a diesel engine, where a wear resistant ring 31 (FIG. 10) of niresist cast iron is cast in in order to ensure wear resistance of the top ring groove 3, provision of a sink head portion 12*b* on a side of the cavity 15 as shown in FIG. 10 gives rise to the following difficulties. That is, the wear resistant ring 31 of niresist cast iron limits the cross-sectional area of a molten metal passage 32 between the cavity 15 and the sink head portion 12*b*. Since the sink head portion 12*b* presses the molten metal sideways, the pressing effect is less transmitted to the thick-walled portion of the piston head. Further since the wear resistant ring 31 is set in the casting mold at a temperature lower than that of the molten metal, solidification of the molten metal in the passage 32 is promoted and the molten metal in the passage 32 is solidified earlier than that in the cavity 15, which deteriorates the pressing effect on the molten metal in the cavity 15.

To the contrast, the composite forming material ring 7 employed in this embodiment in place of the cast iron ring 31 has a high porosity of about 80% and accordingly has a high heat insulating effect. Accordingly, when the molten aluminum alloy is poured into the cavity 15, the ring 7 holds the molten metal in the passage 32 high and delays solidification of the molten metal in the passage 32. In addition, by pressing the sink head portion 12*a* by an air pressure, the pores of the composite forming material ring 7 are well impregnated with the molten aluminum alloy to form a composite portion and at the same time a sufficient pressing effect can be transmitted to the cavity, whereby a piston which is excellent in quality of both the composite portion and the rest. Further since a portion 33 for forming a part of the combustion chamber 30 can be provided on the casting mold 11, the metal structure of the lip portion 30*a* of the combustion chamber 30 can be made fine, whereby thermal fatigue life of the piston 1 can be increased. Further the machining time for forming the combustion chamber 30 can be shortened and yield of material can be improved.

In the manner described above, a cast piston blank 8 of aluminum alloy having a ring-like composite portion 6 cast in a piston body 2 is obtained. The composite portion 6 is formed by impregnating the pores of the nickel porous material with aluminum alloy.

Then the piston blank 8 is heated at 500° C. for 4.5 hours in a heating oven, thereby forming an intermetallic compound layer in the interface between the aluminum alloy and the nickel porous material and subjecting the aluminum alloy matrix to solution treatment, and the piston blank 8 is water-hardened and then annealed at 180° C. for 5 hours.

After subjected to such T6 treatment, the outer surface of the piston body 2 including the composite portion 6 is cut and the top ring groove 3 is cut in the composite portion 6. Further the secondary ring groove 4 and the oil ring groove 5 are cut in the piston body 2.

Since the piston blank 8 as cast is cut in a substantial depth, the quality of the final product is not deteriorated even if the impregnation of the pores of the composite forming material with aluminum alloy at the peripheral portion of the piston body 2 is insufficient to some extent, which permits the gas pressure applied to the cavity to be lower.

Figure 12:
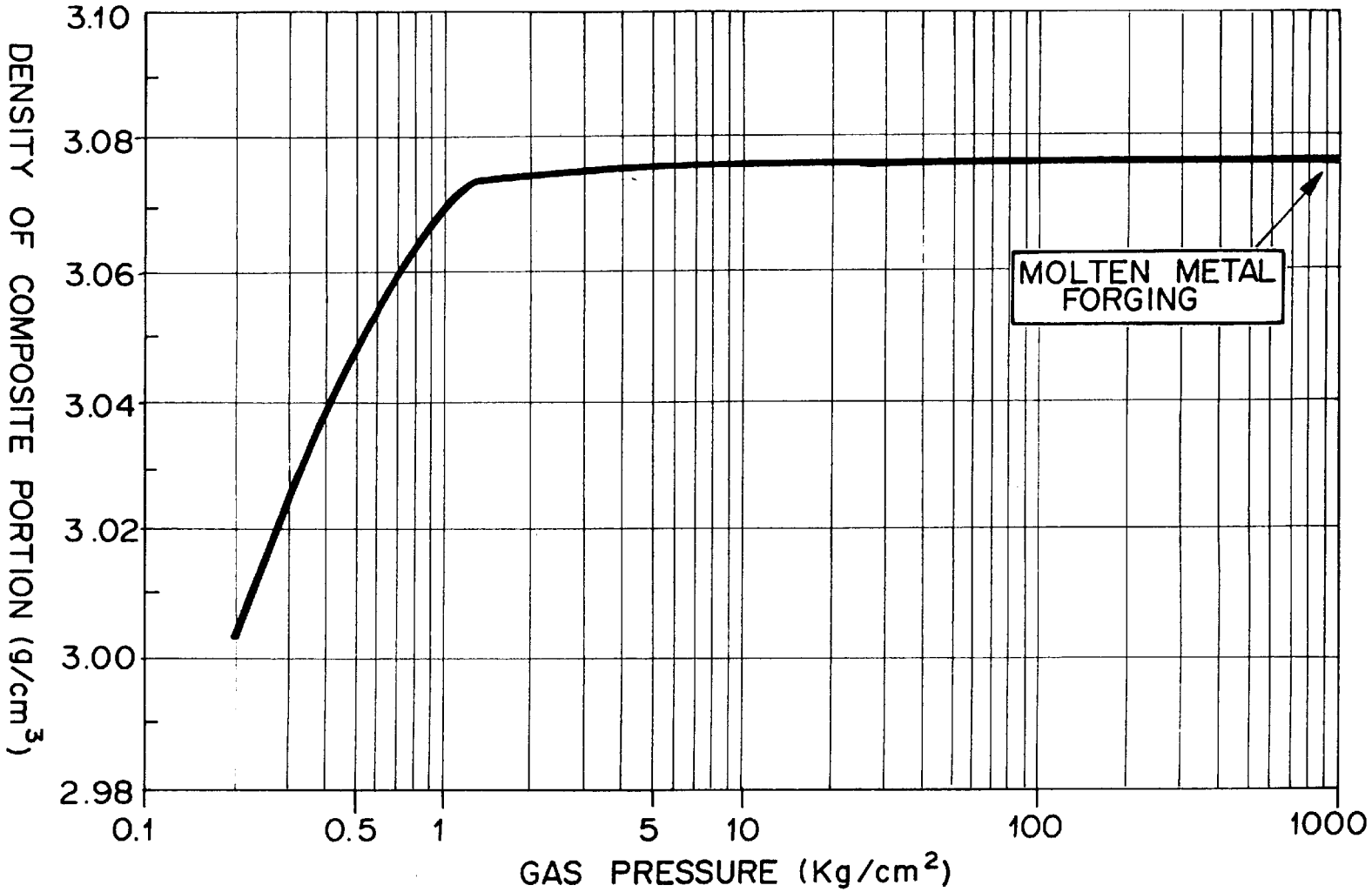
FIG. 12 is a graph showing the relation between the gas pressure and the density of the composite portion.

In the embodiment described above, after the molten aluminum alloy is poured into the cavity 15 through the gate 22, the gate 22 is closed by the cover 23 and pressurized air at about 5 kg/cm$^2$ is introduced into the cavity 15 through the pipe 16 mounted on the cover 23 or the sink head portion 14*a* or 12*a*. As shown in FIG. 12, which shows the relation of the air pressure to the density of the composite portion, the density of the composite portion is substantially constant irrespective of the air pressure in the range not lower than 1 kg/cm$^2$. That is, when the air pressure is at least 1 kg/cm$^2$, the pores of the composite forming material ring 7 can be sufficiently impregnated with aluminum alloy. When the air pressure is lower than 0.5 kg/cm$^2$, combination of the aluminum alloy and the composite forming material tends to be unsatisfactory while when the air pressure is not lower than 0.5 kg/cm$^2$, combination of the aluminum alloy and the composite forming material is satisfactory. However when the air pressure exceeds 30 kg/cm$^2$, a large mold clamping force is required in order to prevent molten metal leak through the parting faces of the split mold, which is undesirable. Accordingly, preferably the air pressure is not higher than 30 kg/cm$^2$, and more preferably not higher than 10 kg/cm$^2$. Thus it is preferred that the air pressure be in the range of 0.5 to 10 kg/cm$^2$.

Though in the embodiment described above, the ring 7 is formed of nickel porous material having a volume factor of 5%, the ring 7 may be of a molded body of stainless steel fiber.

For example, stainless steel fiber having a mean diameter of about 30 $\mu$m is press-molded into a desired shape and fired at 1130° C. for 2 hours in denatured butane gas atmosphere, thereby obtaining a ring 7 having a volume factor of 10%. Then the ring 7 is set in the casting mold 11 and molten aluminum alloy (AC8A) is poured. Thereafter the gate 22 is closed and an air pressure of 3 kg/cm$^2$ is kept applied to the sink head portion until the molten aluminum alloy is solidified. Thus a composite portion 6 is formed.

Casting of a bearing cap for a cylinder block

Figure 13:
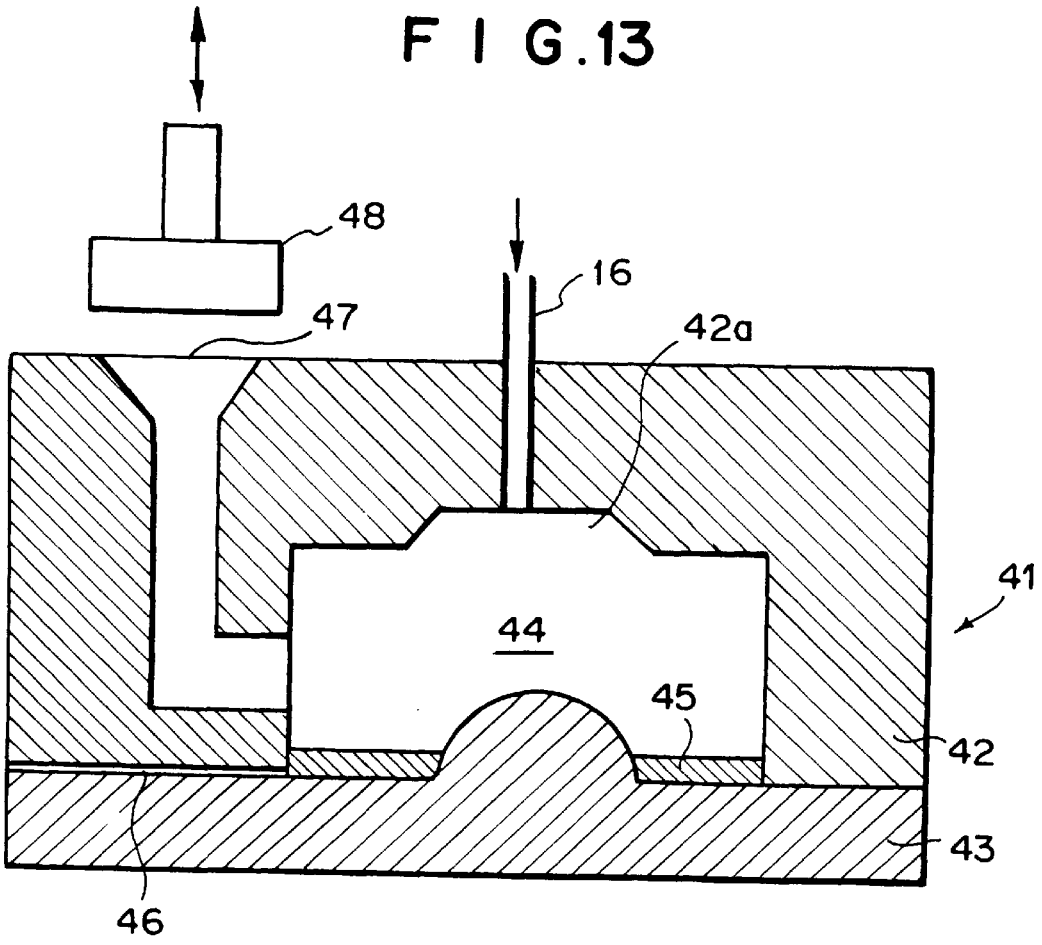
FIG. 13 is a cross-sectional view of an example of a casting mold for casting a bearing cap of a cylinder block in accordance with the method of the present invention.

FIG. 13 is a schematic cross-sectional view of an example of a casting mold which is suitable for casting a bearing cap having a composite portion in the surface to be in contact with a bearing portion of a cylinder block formed in accordance with the method of the present invention.

In FIG. 13, the casting mold 41 comprises an upper mold 42 and a lower mold 43, and a cavity 44 and a sink head portion 42*a* are formed in the upper mold 42. A molded body 45 of, for instance, short alumina fiber having a volume factor of 10% is set on the lower mold 43. A vent groove 46 is formed in the parting face between the upper and lower molds 42 and 43.

Then molten aluminum alloy is poured into the cavity 44 through a gate 47. Thereafter the gate 47 is closed by a cover 48 and an air pressure is applied to the molten metal through a pipe 16 disposed in the sink head portion 42*a,* thereby impregnating the pores of the composite forming material molded body 45 with molten metal. Thus a composite portion is formed on the surface to be in contact with a bearing portion of a cylinder block, thereby suppressing thermal expansion.

Casting of a connecting rod

Figure 14:
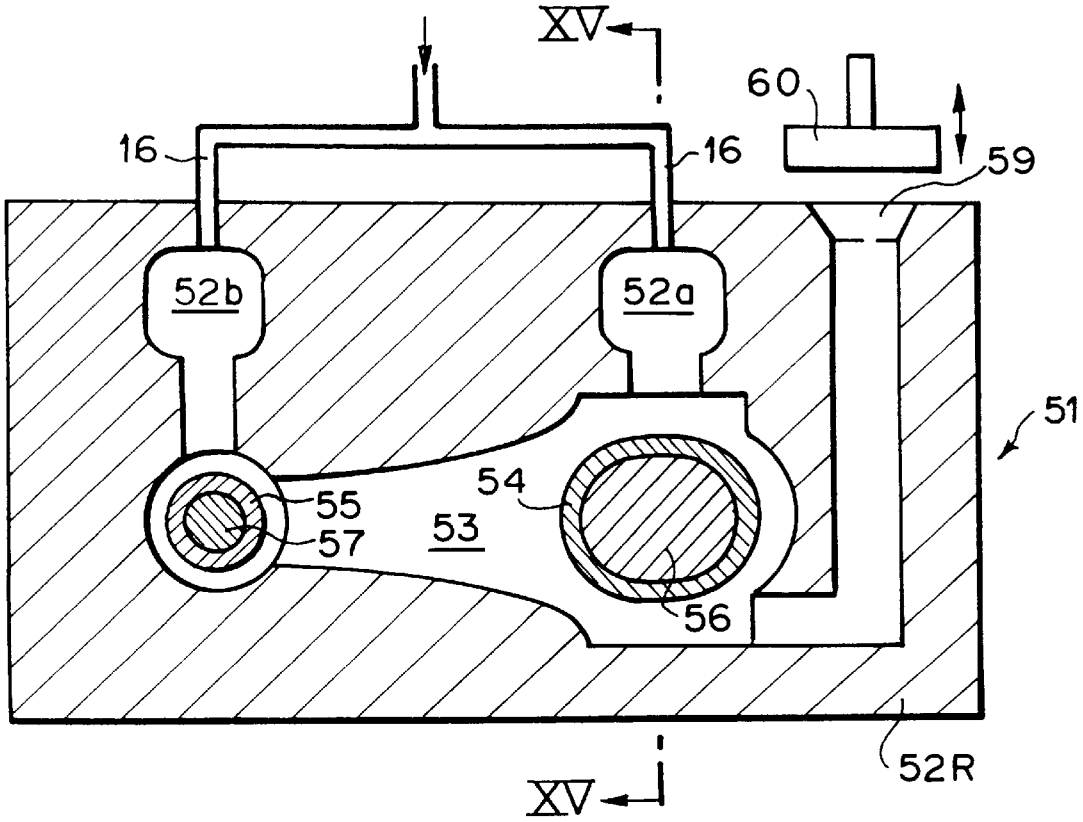
FIG. 14 is a cross-sectional view of an example of a casting mold for casting a connecting rod in accordance with the method of the present invention.
Figure 15:
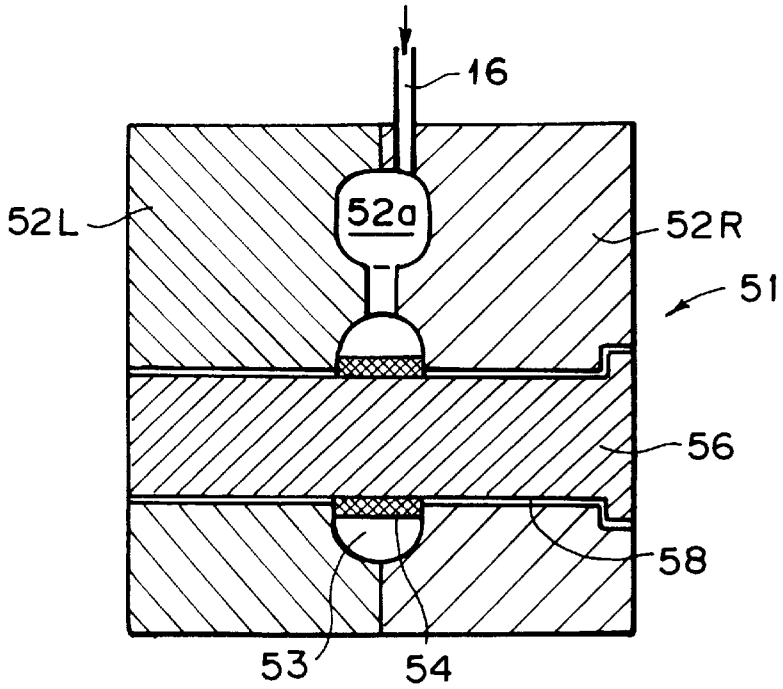
FIG. 15 is a cross-sectional view taken along line XV—XV in FIG. 14.

FIGS. 14 and 15 show an example of a casting mold which is suitable for casting a connecting rod having a composite portion on the inner surface of each of pin holes on big and small ends formed in accordance with the method of the present invention.

The casting mold 51 comprises left and right outer molds 52L and 52R forming a cavity 53. Porous composite forming material rings 54 and 55, which are, for instance, molded bodies of short alumina fiber, the former being larger than the latter, are supported respectively by core pins 56 and 57 in positions corresponding to the big and small ends of the connecting rod. Sink head portions 52*a* and 52*b* are provided respectively for the big and small ends. Each of the sink head portions 52*a* and 52*b* is connected to an air pipe 16 and an air pressure is applied to both the sink head portions 52*a* and 52*b*. Vent grooves 58 are formed between each of the core pins 56 and 57 and the left outer mold 52L and between each of the core pins 56 and 57 and the right outer mold 52R.

After molten aluminum alloy is poured into the cavity 53 through a gate 59, the gate 59 is closed by a cap 60 and pressurized air is introduced through the pipes 16 in the sink head portions 52*a* and 52*b,* thereby pressurizing the molten metal. Thus the pores of the composite forming material rings 54 and 55 are impregnated with molten aluminum alloy to form composite portions, thereby suppressing thermal expansion. After a bearing cap portion is cut off from the big end of the cast connected rod, machining is carried out on the connecting rod.

The method of the present invention may be applied to various parts without limited to the piston, the bearing cap and the connecting rod described above. Further the light alloy need not be limited to aluminum alloy but other light alloy such as magnesium alloy may be employed.

What is claimed is:

1. A method for casting comprising the steps of:

forming a porous composite forming material which has a volume factor of 5 to 20% into a shape of a portion of a product, holding said porous composite forming material in a cavity of a casting mold in such a manner that said material is brought into contact with an inner surface of the casting mold, pouring molten light alloy into the cavity of the casting mold, introducing gas into the cavity of the casting mold at a pressure of 0.5 to 10 kg/cm$^2$ with a gate of the cavity closed while the introduced gas causes gas in the composite forming material to come out and be released through a gas release passage formed in the casting mold and in communication between an inside and an outside of the cavity, thereby impregnating the pores of the porous composite forming material with the molten light alloy, and forming said portion by compounding the light alloy and the composite forming material.

2. A method as defined in claim 1 in which said composite forming material is previously formed in a ring like shape.

3. A method as defined in claim 1 in which said gas release passage is formed in a parting face of the casting mold.

4. A method for casting comprising the steps of:

forming a porous composite forming material which has a volume factor of 5 to 20% into a shape of a portion of a product, holding said porous composite forming material in a cavity of a casting mold in such a manner that said material is brought into contact with an inner surface of the casting mold, and holding a disintegrating core in the cavity, pouring molten light alloy into the cavity of the casting mold, introducing gas into the cavity of the casting mold at a pressure of 0.5 to 10 kg/cm$^2$ with a gate of the cavity closed while the introduced gas causes gas in the composite forming material to be released through a gas release passage which is formed in the casting mold and is in communication between an inside and an outside of the cavity, thereby impregnating the pores of the porous composite forming material with the molten light alloy, and forming said portion by compounding the light alloy and the composite forming material.

5. A method as defined in claim 4 in which said disintegrated core is a salt core.

6. A method as defined in claim 1 or 4 in which said portion is to be formed into a groove in which a piston ring is provided.

7. A method as defined in claim 1 or 4 in which said composite forming material is selected from a group consisting of porous material of metal or fiber of metal having a volume factor of 5 to 20%.

8. A method as defined in claim 1 or 4 in which said composite forming material is selected from a group consisting of short fiber of inorganic material or whisker having a volume factor of 5 to 10%.

9. A method as defined in claim 1 or 4 in which said composite forming material is inorganic particles having avolume factor of 5 to 10%.

10. A method as defined in claim 1 or 4 in which said gas is introduced through the gate.

11. A method as defined in claim 1 or 4 in which said gas is introduced through the gate.

12. A method as defined in claim 1 or 4 in which said gas is introduced through a sink head portion.

13. A method as defined in claim 1 or 4 in which said gas is air.

14. A method as defined in claim 1 or 4 further comprising a step of carrying out a heat treatment on said portion.

15. A casting apparatus comprising:

a casting mold holding a porous composite forming material in such a manner that said material is brought into contact with an inner surface of a cavity of the casting mold, and such that said porous composite forming material is formed into a shape of a portion of a product and having a volume factor of 5 to 20%, a pourer which pours molten light alloy into the cavity of the casting mold, a conduit which introduces gas into the cavity in the casting mold at a pressure of 0.5 to 10 kg/cm$^2$ with a gate of the cavity closed, and a gas release passage formed in the casting mold so that an inside and an outside of the cavity is communicated, wherein gas in the composite forming material is pushed out from the casting mold through the gas release passage, and said portion is formed by compounding the light alloy and the composite forming material.

16. A casting apparatus as defined in claim 15 in which said gas release passage is formed in a parting face of the casting mold.

17. A casting apparatus comprising:

a casting mold holding a porous composite forming material in such a manner that said material is brought into contact with an inner surface of a cavity of the casting mold, and such that said porous composite forming material is formed into a shape of a portion of product having a volume factor of 5 to 20%, and holding a disintegrating core in the cavity, a pourer which pours molten light alloy into the cavity of the casting mold, and a conduit which introduces gas into the cavity in the casting mold at a pressure of 0.5 to 10 kg/cm$^2$ with a gate of the cavity closed while the introduced gas causes gas in the composite forming material to be released through a gas release passage which is formed in the casting mold and is in communication between an inside and an outside of the cavity, wherein said portion is formed by compounding the light alloy and the composite forming material.

18. A casting apparatus as defined in claim 17 in which said disintegrated core is a salt core.

19. A casting apparatus as defined in claim 15 or 17 in which said composite forming material is previously formed in a ring like shape.

20. A casting apparatus as defined in claim 15 or 17 in which said portion is to be formed into a groove in which a piston ring is provided.

21. A casting apparatus as defined in claim 15 or 17 in which said composite forming material is selected from a group consisting of short fiber of inorganic material or whisker having a volume factor of 5 to 20%.

22. A casting apparatus as defined in claim 15 or 17 in which said composite forming material is selected from a group consisting of short fiber of inorganic material or whisker having a volume factor of 5 to 10%.

23. A casting apparatus as defined in claim 15 or 17 in which said composite forming material is inorganic particles having a volume factor of 5 to 10%.

24. A casting apparatus as defined in claim 15 or 17 in which said gas is introduced through the gate.

25. A casting apparatus as defined in claim 15 or 17 in which said gas is introduced through a sink head portion.

26. A casting apparatus as defined in claim 15 or 17 in which said gas is air.

27. A casting apparatus as defined in claim 15 or 17 further comprising an apparatus which heats said portion.

* * * * *